US005277454A

United States Patent [19]

Lorch et al.

[11] Patent Number: 5,277,454

[45] Date of Patent: Jan. 11, 1994

[54] HAND SHOWER FIXTURE

[75] Inventors: Werner Lorch, Schramberg; Werner Finkbeiner; Alois Schoenweger, both of Schiltach, all of Fed. Rep. of Germany

[73] Assignee: Hans Grohe GmbH & Co. KG, Schiltach, Fed. Rep. of Germany

[21] Appl. No.: 762,854

[22] Filed: Sep. 18, 1991

[30] Foreign Application Priority Data

Sep. 20, 1990 [DE] Fed. Rep. of Germany ..... 4029792

[51] Int. Cl.[5] ..... F16L 33/00

[52] U.S. Cl. ..... 285/15; 285/119; 285/158; 285/192; 285/319; 285/64; 239/587.1

[58] Field of Search ..... 285/15, 16, 17, 64, 285/319, 119, 192, 8, 158; 239/587.1, 587.2, 587.3; 137/801

[56] References Cited

U.S. PATENT DOCUMENTS 3,680,780 8/1972 Arbon ..... 239/26

FOREIGN PATENT DOCUMENTS 296470 12/1988 European Pat. Off. .
1955776 5/1971 Fed. Rep. of Germany .
2709446 1/1979 Fed. Rep. of Germany .
3634738 4/1988 Fed. Rep. of Germany .
3721152 1/1989 Fed. Rep. of Germany .
3840721 6/1990 Fed. Rep. of Germany .

*Primary Examiner*—Dave W. Arola
*Attorney, Agent, or Firm*—Eckert Seamans Cherin & Mellott

[57] ABSTRACT

In a bath rim fitting or other fitting, in which a shower hose extends through a plate or the like and whose back is difficultly accessible, it is proposed to connect the shower hose to the fixed pipe with the aid of a pressure hose. The pressure hose is sufficiently long that it can at least be drawn up to the plate opening by pulling on the shower hose, so that it is possible to replace the latter in front of or outside the plate.

20 Claims, 3 Drawing Sheets

HAND SHOWER FIXTURE

BACKGROUND OF THE INVENTION

The invention relates to a means for fixing a hand shower unit, in which the shower hose is passed through an opening.

Such shower fittings are e.g. known in connection with wash stands or are positioned laterally alongside bath tubs. Following the installation of the bath tub, it is no longer possible to connect the fittings to the fixed supply network in the normal circumstances. Thus, the problem exists of fitting a new shower hose or replacing an existing shower hose.

A wash basin means is known (German patent 27 09 446), in which the water discharge fitting and the valves are located on a removable stop plate of an inspection opening and the connection between the fittings and the connections takes place by flexible line or pipe sections. Here again, the possibility of fitting or replacement is brought about through the stop or closure plate being removable.

A fitting means is also known (DE-C-36 34 738), in which a built-in box is connected to a water supply pipe laid in fixed manner and in said box is connected a shower adapter, which can be removed. Here again, a plate is removed to give access to the fastening of the shower hose. In the vicinity of its lower end, the built-in box has an outlet connected to the bath tub drain. Here, it is possible to drain off the water which has penetrated the shower hose passage. However, the connection to the water drain for the bath tub is lower than the maximum water level therein, so that on opening the bath outlet, there is a risk of dirty water being forced back. The fitting of a check valve to prevent a backwash does not lead to satisfactory results, because reliable operation cannot be ensured as a result of the contamination risk.

The invention aims at providing a simple and inexpensively manufacturable and fittable means for fixing a hand shower unit, in which the possibility of connecting the shower hose and also replacing the same is made easier. This problem is solved by a means having the features of claim 1.

Normal shower hoses, which have been developed for ease of handling and optical appearance, are in normal use subject to a certain wear, which can lead to a certain lack of watertightness in the vicinity of a connecting nipple or to a deterioration of their appearance. Thus, there is a need to replace the shower hose. Conventional pressure hoses, which have only been optimized in connection with strength and good watertightness, have a much longer life and consequently do not need to be replaced. Thus, according to the invention, if the shower hose has to be replaced, it is drawn out of the passage to such an extent that access is given to the connection point of the shower hose and the pressure hose and then the shower hose can be replaced. This can also occur during the initial installation. There is no need to remove fitting or tap banks and the like, and following the replacement, they do not have to be refitted, accompanied by resealing. This leads to a considerable reduction cost both during the manufacture and during the fitting of the hand shower unit.

According to a further development of the invention, the unintentional removal of the connection of the shower hose to the pressure hose is prevented. As a result, the normal user does not notice that a pressure hose is attached to the shower hose. Only the installer or trained user wishing to carry out a replacement will overcome the obstacle preventing pulling out. For example, the connection may only be removable in a specific angular position. The invention also proposes that the passage has a removable blocking element, the latter then being removed if the connection has to be pulled out.

According to a further development, the shower hose is pulled out of the passage to such an extent that the connection is located outside the passage, so that fitting or replacement can then be carried out particularly easily.

The means proposed by the invention is not only advantageous in the case of bath tub edge batteries or built-in wash tables, but also whenever the shower hose has to be passed through an opening in an element in which the back, i.e. the side opposite to the hand shower unit is difficult to access or is inaccessible.

To prevent an unintended sliding or slipping out of the connection between the shower hose and the pressure hose, particularly if the shower hose has just been unscrewed, the invention provides for means for preventing the shower hose from inadvertently sliding out. This can be brought about in that the passage and/or the pressure hose are so constructed and/or matched to one another that the unintentional sliding out of the pressure hose end associated with the shower hose is prevented.

For example, the corresponding pressure hose end can have a spring element, which expands on pulling out and is fixed by self closure and/or force closure in or on the passage. Only as a result of a positive spreading back of the spring element can the hose slide back again.

In order to solve the problem of the spray water passing through the passage, the invention proposes that the shower hose be surrounded between the passage and the connection point to the pressure hose by a downwardly watertight container. Although this does not prevent the passage of spray water through the passage member, which is virtually impossible, it still ensures that this water does not seep out anywhere. The container can be emptied at regular intervals from the top. In particular, the invention proposes that the connecting nipple of the shower hose is located in the container. If the connecting nipple leaks, this lack of tightness does not lead to significant damage, because the water then collects in the container.

For particularly simple emptying or replacement of the container, according to the invention, said container is completely movable on the outside of the passage. It can be emptied there or, if necessary, can also be dismantled and replaced.

One possibility for the construction of the container according to the invention involves it being surrounded by a fixed sleeve, which can be removed from an opening.

A particularly preferred possibility comprises the container being formed by a flexible hose sleeve or protective hose, which is connected in watertight manner to the shower hose and/or the pressure hose in the vicinity of its one end. In particular, the hose sleeve is connected in watertight manner at both ends.

In particular, in the vicinity of its other end the sleeve is connected in watertight manner to the passage. Thus, in this case, the shower hose is surrounded over its entire length below or behind the passage by a second protective hose, preferably in spaced manner and which collects water passing out of a leak or through the passage.

According to a further development, the hose sleeve is so connected to the passage that an unintentional drawing out of said sleeve from the passage is prevented. This makes it possible to ensure that in the case of a powerful pulling out of the shower hose any dirty water present does not spray out of the passage. As a result of this measure the normal user does not even notice that his fitting has a special feature.

According to the invention, the hose sleeve contains a diameter-corresponding helical compression spring, which preferably extends over the entire hose sleeve length. This helical compression spring protects the hose sleeve or protective hose from bending and also has the secondary effect that the shower hose is drawn into the passage with a tension determined by the strength of the said spring.

According to the invention, the hose sleeve and the helical compression spring are slipped in the end region onto an envelope and jointly moulded round with plastic. This can involve a slipping onto an envelope from the outside and a corresponding injection moulding round from the outside or conversely a slipping on from the inside and an injection moulding round from the inside. Thus, the protective hose together with the helical compression spring is manufactured as a single, sealed and easily fitted component.

According to the invention, said envelope can be connected at one end to the passage, while in the vicinity of the other end, it is optionally connected with a connecting element in the vicinity of the connection between the two hoses.

The invention particularly proposes that the hose sleeve is connected to a detachable connecting piece of the passage. Only through releasing the connecting piece can the shower hose be pulled out to such an extent that the protective hose and the connection point with the pressure hose pass in front of the passage. The detachable connecting piece can consequently form a blocking element for the drawing out of the pressure hose.

According to the invention the connecting piece can be removed after taking out a locking member and the latter can e.g. be a cap nut or collar.

BRIEF DESCRIPTION OF THE DRAWINGS

Further features, details and advantages of the invention can be gathered from the following description of preferred embodiments and the attached drawings, wherein.

DETAILED DESCRIPTION OF THE PREFERRED EMBODIMENT

Figure 1:
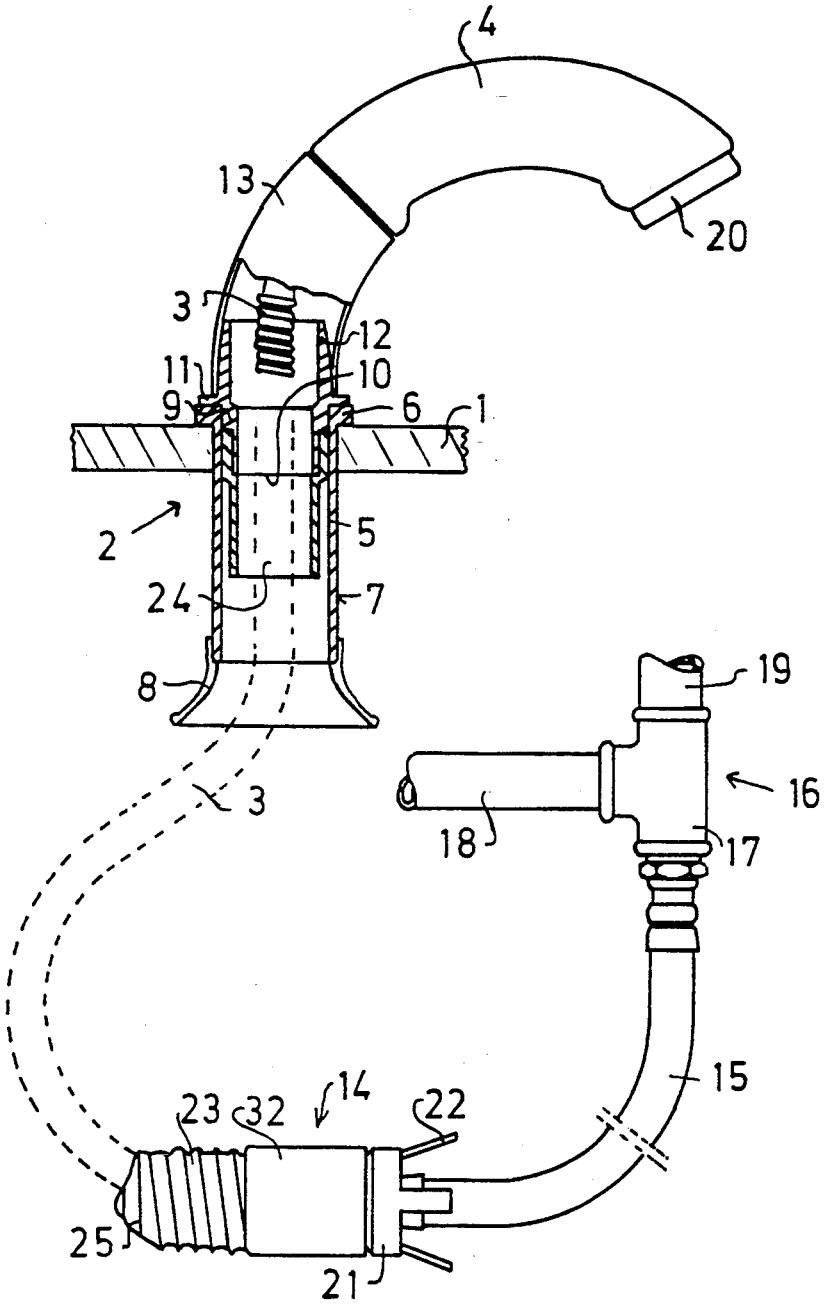
FIG. 1 shows diagrammatically the inventive arrangement of a hand shower unit on a horizontal plate.

FIG. 1 shows a horizontally directed plate 1 in broken away form. The plate 1 contains an opening, which forms a passage 2 for the shower hose 3 of a hand shower unit 4 indicated in broken line manner. In the represented position the shower hose 3 passes in a loop below the plate 1, namely on the inside thereof. Above the plate 1 or on the outside of the passage 2 is provided the hand shower unit 4. If it is drawn out upwards, then the hose 3 is drawn through the passage 2.

The passage 2 contains a passage element 5 drawn from above through the opening of the plate 1 and which in the vicinity of its top surface forms an outwardly directed rim 6, which is provided with a thread on its outside. The passage member 5, which is in the form of a shaft, also has a thread on its outside 7. With the shoulder formed by the underside of its rim 6 and optionally accompanied by the interposing of a seal, the passage member engages on the top of the plate 1. From the underside e.g. a nut is screwed onto the outside of the passage member 5 and against the underside of the plate 1, so that the passage member 5 is then fixed. A funnel element 8, which is downwardly extended in rounded manner is then screwed onto the lower end of the passage member 5.

Figure 2:
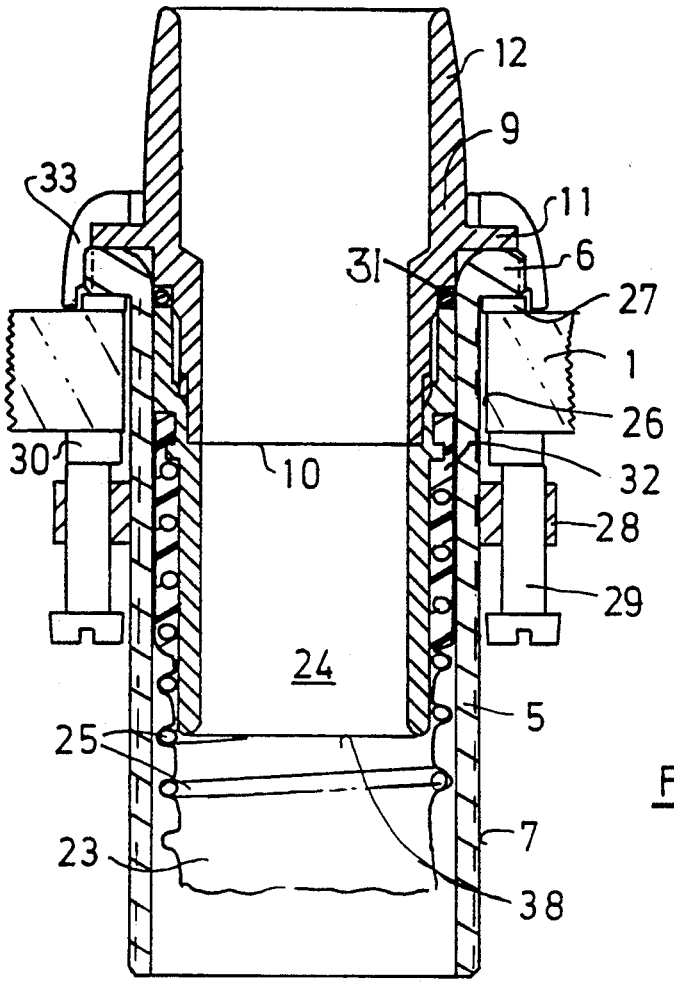
FIG. 2 shows a larger scale the passage through the plate.

A connecting piece 9 having in the vicinity of its lower end 10 an outer thread is inserted from the top in the passage member 5. The connecting piece 9 contains an outwardly directed flange 11, with which it bears on the top of the rim 6 of the passage member 5. In its further upwardly directed region, the connecting piece 9 is constructed as a soldering cone 12. Onto the outside of said cone 12 is soldered an arcuate tube 13, which forms a mounting support for the hand shower unit 4. The connecting piece 9 is secured by a cap nut 33 being screwed onto the outer thread of the rim 6 of the passage member 5, with which a shoulder secures the flange 11. The cap nut 33 is shown in FIG. 2 and further reference thereto will be made hereinafter.

Through the hollow interior of the connecting piece 9 extends in spaced manner the shower hose 3, which is e.g. constructed as a metal link hose. To its lower end in FIG. 1, which is remote from the hand shower unit 4, the shower hose 3 is connected at a connecting point 14 to the end of a conventional pressure hose 15. Details of the connection of the shower hose 3 to the pressure hose 15 are not shown, because such connections are well known. The pressure hose 15 is unscrewed from a fixed water feedline 16, which in the represented embodiment has a T-piece 17. Into the T-piece 17 leads a pipe 18 for cold water coming from a valve and a pipe 19 for hot water coming from another valve. The water coming from both valves passes via the T-piece 17 through the pressure hose 15 into the shower hose 3 and from there to the hand shower unit 4, which it leaves through a jet surface 20.

The length of the pressure hose 15 is such that it extends from the fixed pipe 16 to the passage 2 and preferably somewhat further. As a result by pulling on the shower hose 3, the connecting point 14 can be moved up to the passage 2 so that the shower hose 3 can then be detached from the pressure hose 15.

In the vicinity of the connecting point 14 between the shower hose 3 and the pressure hose 15 is provided a connector 21, which has four outwardly spread, resilient legs 22. The spreading or expansion of the legs 22 takes place in a direction leading from the passage 2 to the fixed supply pipe 16.

The shower hose 3 along its length between the passage 2 and the connecting point 4 to the pressure hose 15 is surrounded by an only partly shown protective hose or hose sleeve 23, which contains in the vicinity of its two ends in each case one envelope 24 to which it is connected in watertight manner. In the vicinity of its one end, the hose sleeve 23 is connected with the aid of the envelope 24 in watertight manner to the connector 22 of the pressure hose 15. In the vicinity of its opposite end, the hose sleeve 23 is connected with the aid of its envelope 24 in watertight manner to the passage 2, and in the represented embodiment, to the passage member 5. This takes place in that the envelope 24 has on its inside an inner thread, with which it is screwed onto the outer thread of the connecting piece 9, accompanied by the interposing of a seal or packing.

Therefore, in the area below the plate 1 and up to its connection to the pressure hose 15, the shower hose 3 is surrounded by a container formed by the hose sleeve 23, which is downwardly sealed in watertight manner. The only opening is the inside of the envelope 24, which is only open in the upwards direction. If with the shower unit 4 removed, water passes through the tube 13 and the passage 2 into the hose sleeve 23, the water cannot leak but can be emptied again from the top.

The hose sleeve 23 has on its inside a helical compression spring 25 extending over the entire length of sleeve 23 and whose diameter is somewhat larger than that of sleeve 23. The helical compression spring prevents bends in the hose sleeve 23 and also the shower hose 3 spaced therefrom and simultaneously draws the hose 3 downwards through the passage 2.

Details of the passage are shown in FIG. 2. The passage member 5 is inserted through the opening 26 of the plate 1. Between the underside of its rim 6 and the top of the plate 1 is inserted a circular sealing element 27. Onto the outer thread of the passage member 5 is screwed a tightening nut 28, until it has a limited distance from the underside of the plate 1. Through the tightening nut 28 are screwed two screws 29, whose ends press onto a ring 30 placed round the opening 26. By tightening the screw 29 the passage member 5 is braced on the plate 1.

The sleeve 24 is screwed by its inner thread located on its outer end onto the outer thread of the connecting piece 9. Between an axial shoulder of the connecting piece 9 and an end face of the envelope 24 is inserted a packing 31, which also engages on the inside of the passage member 5. Thus, the envelope 24 is sealed in watertight manner with respect to the connecting piece 9 and the passage member 5.

Onto the outside of the sleeve 24 is slipped the end of the helical compression spring 25 and the end of the hose sleeve 23, and said end is surrounded by a plastic injection molded part 32, which is manufactured prior to installation. During installation the protective hose 23 provided with the sleeve 24 and the helical compression spring 25 is screwed onto the connecting piece 9, accompanied by the interposing of the packing 31.

The underside of the flange 11 of the connecting piece 9 engages on the top of the rim 6 of the passage member 5. By a pin engaging in an opening of the rim 6, rotation thereof can be prevented, although this is not necessary. The connecting piece 9 is secured by a cap nut 33, which is screwed by a thread located on its inside into the outer thread of the rim 6 of the passage member 5. The cap nut 33 with a downwardly directed shoulder secures the flange 11.

Figure 3:
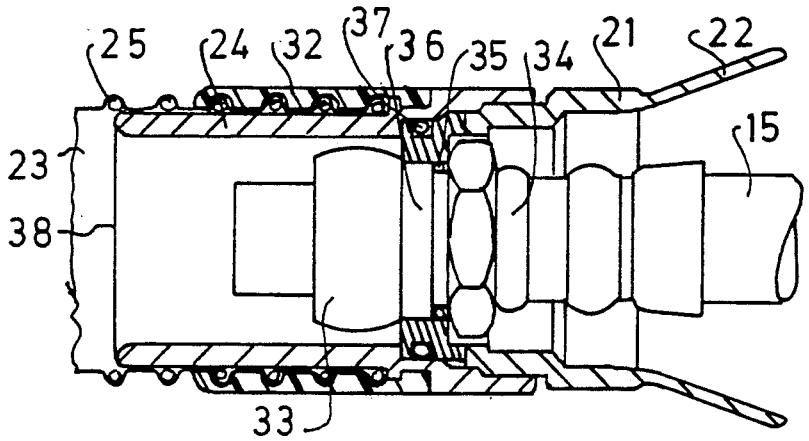
FIG. 3 shows the connection of the shower hose to the pressure hose.

The opposite end of the protective hose 23 is shown in FIG. 3, which represents the connecting point 14 between the shower hose 3 and the pressure hose 15. The end of the shower hose 3 contains a conventional connecting nipple 33, which is screwed to the conventional connecting nipple 34 of the pressure hose 15. Between the two elements provided with key faces is inserted a ring element 36, accompanied by the interposing of a packing 35, which is lodged between one face of the envelope 24 of the protective hose 23 and one face of the connecting element 21. The envelope 24 is screwed onto connecting element 21. The spring element 36 also contains a packing 37 on its outside. The packings serve to seal with respect to the outside the end of the envelope 24.

As has already been mentioned in connection with FIG. 1, the connector 21, which is connected to the end of the pressure hose 15, contains a spring element with four resilient arms 22.

Following installation the hand shower unit assumes the position shown in FIG. 1. If a user wishes to use the shower unit 4, he can remove it from the pipe 13, draw the shower hose out of the passage 2 and shower himself. The shower hose 3 can be drawn out against the action of the spring 25 only to the extent that either the spring coils rest on the block or the terminal edges 38 of the envelopes 24 directed away from the free ends of the protective hose 23 contact one another. A further pulling out is not possible.

The need may arise to remove the water which has collected in the hose sleeve 23, or to check or replace the latter, or even to replace the shower hose 3. In order to be able to empty or replace the protective hose 23, the cap nut 33 is loosened, which can take place from the top of the plate 1. The connecting piece 9 with the upper end of the hose sleeve 23 fixed thereto can then be drawn out upwards. On now simultaneously pulling on the shower hose 3, the opposite end of the sleeve 23 is also drawn out. As both ends of the hose sleeve 23 at least have identical external diameters and are preferably completely identical, the envelope 24 with its plastic part 33 on the opposite end of the protective hose 23 can be drawn out through the passage member 5. If the opposite end of the hose sleeve 23 now passes into the passage member 5, then the spring arms 22 of the connector 21 are pivoted inwards and also the end of the pressure hose 15 can be drawn upwards through the passage member 5. The protective hose 23 can be detached from the connector by action on the envelope 24.

In order to now also be able to unscrew the shower hose, pulling preferably continues until the spring arms 22 on the outside of the passage member 5 spread outwards, so that an unintentional sliding back of the pressure hose 15 is prevented.

Figure 4:
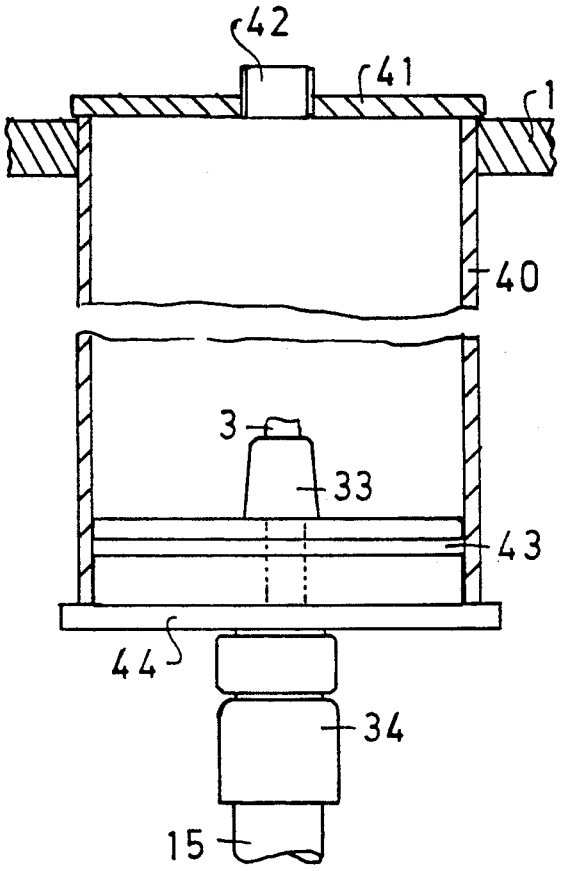
FIG. 4 shows a view corresponding to FIG. 2 of another embodiment.

FIG. 4 shows a second embodiment of the means for fixing a hand shower unit proposed by the invention. Whereas in the embodiment according to FIGS. 1 to 3 the container surrounding the shower hose 3 below the plate 1 is formed by a flexible hose 23, in the embodiment according to FIG. 4 it is formed by a rigid container 40. The rigid container 40 is inserted through an opening in the plate 1 and sealed on the outside by a cover plate 41. A shower hose passage 42 is provided in the cover plate 41.

The container 40 is sealed in watertight manner in the vicinity of its lower end by a stop plate 44 provided with a slot 43 for receiving a packing. To the underside of the stop plate 44 is screwed the pressure hose 15 with its nipple 34 in an axial through opening and the shower hose 3 with its nipple 33 is screwed to the other end on the top of the plate 44. Any water passing through the passage 42 of the shower hose 3 can be collected in the container 40, which can also be moved upwards, giving access. If the stop plate 44 is designed in some other way, i.e. without any radial projection, then the container 40 can be removed upwards entirely out of the plate 1, so that then access is possible to the connecting nipple 34 of the pressure hose 15. In the represented embodiment the container can be drawn upwards from the stop plate 44, so that there is also access to the connecting nipple 33 of the shower hose 3.

As a function of the size of the container 40, in the embodiment according to FIG. 4, a shower hose can also be used, which in the relaxed state is in the form of a helical compression spring. Such preshaped shower hoses are known.

We claim:

1. A hand shower fixture, comprising:

a hand shower unit for discharging water;

a shower hose having two opposite ends, one of the ends of the shower hose defining an exterior end and having means coupling the shower hose to the hand shower unit;

a passage means through which the shower hose passes such that the hand shower unit is located on an exterior side of said passage means, a second one of the two opposite ends of the shower hose being an interior end, normally located on an interior side of said passage means;

a pressure hose having two ends, one end of the pressure hose having means connectable to a fixed feed pipe, and the other end of the pressure hose having means connectable to the interior end of the shower hose, thereby defining a flow path from the feed pipe through the pressure hose and the shower hose to the hand shower unit, the pressure hose having a sufficient length that upon withdrawal of the shower hose through said passage means the pressure hose extends at least from the fixed feed pipe to the passage means; and, a container surrounding a length of the shower hose between the passage means and the connector, the container being sealed watertight with at least one of the shower hose and the pressure hose adjacent the interior end of the shower hose.

2. The fixture according to claim 1, further comprising a connector coupling the shower hose and the pressure hose at the interior end of the shower hose, the connector and the passage means preventing unintentional passage of said connector through said passage means from the interior side of the passage means to the exterior side upon withdrawal of the shower hose, by interference between the connector and the passage means.

3. The fixture according to claim 2, further comprising means for relieving said interference between the connector and the passage means, whereby the shower hose can be drawn out through the passage means until the connector is on the exterior side of the passage means.

4. The fixture according to claim 3, wherein said means for preventing unintentional passage of said connector through said passage means is further operable for releasably preventing passage of the connector from the exterior side of the passage means to the interior side, whereby said other end of the pressure hose connectable to the interior end of the shower hose, is held on the exterior side of the passage means when said connector is drawn out through the passage means.

5. The fixture according to claim 1, wherein the connector coupling the shower hose and the pressure hose at the interior end of the shower hose includes a connecting nipple coupling the interior end of the shower hose to the pressure hose, and wherein said nipple is located in the container.

6. The fixture according to claim 1, further comprising means for mounting the passage means in an opening in a plate, and wherein the container is completely movable through the opening in the plate, to the exterior side of the passage means.

7. The fixture according to claim 1, wherein the container is formed by a fixed sleeve, which can be removed through said passage means to said exterior side of the passage means.

8. The fixture according to claim 1, wherein the container is formed by a flexible hose sleeve, and further comprising means coupling the hose sleeve in watertight manner to one of the shower hose and the pressure hose, adjacent the interior end of the shower hose.

9. The fixture according to claim 8, further comprising means coupling the hose sleeve in watertight manner to the passage means at an end of the hose sleeve remote from the interior end of the shower hose.

10. The fixture according to claim 9, further comprising a helical compression spring having a diameter approximately corresponding to the hose sleeve, said compression spring being located in said hose sleeve and extending over an entire length of the hose sleeve.

11. The fixture according to claim 10, further comprising at least one inner sleeve comprising molded plastic, disposed on an end region of the hose sleeve and the compression spring.

12. The fixture according to claim 11, further comprising means coupling the at least one inner sleeve in watertight manner to the passage means.

13. The fixture according to claim 11, further comprising means coupling the at least one inner sleeve in watertight manner to said connector.

14. The fixture according to claim 8, wherein the passage means comprises a detachable connecting piece, and further comprising means coupling the hose sleeve to the passage means at the detachable connecting piece.

15. The fixture according to claim 14, further comprising means for mounting the passage means at an opening in a plate, and wherein the passage means comprises a removable locking device for retaining the connecting piece relative to the plate.

16. The fixture according to claim 11, wherein the hose sleeve is identically constructed at opposite ends coupled respectively to the passage means and adjacent the interior end of the shower hose.

17. The fixture according to claim 1, further comprising removable means for preventing unintentional removal of the container from the passage means by interference between the container and the passage means.

18. The fixture according to claim 1, wherein the passage means further comprises a mounting support for supporting the hand shower unit on the interior side of the passage means.

19. A hand shower fixture, comprising:

a hand shower unit for discharging water;

a shower hose having two opposite ends, one of the ends of the shower hose defining an exterior end and having means coupling the shower hose to the hand shower unit;

a passage means through which the shower hose passes such that the hand shower unit is located on an exterior side of said passage means, a second one of the two opposite ends of the shower hose being an interior end, normally located on an interior side of said passage means;

a pressure hose having two ends, one end of the pressure hose having means connectable to a fixed feed pipe, and the other end of the pressure hose having means connectable to the interior end of the shower hose, thereby defining a flow path from the feed pipe through the pressure hose and the shower hose to the hand shower unit, the pressure hose having a sufficient length that upon withdrawal of the shower hose through said passage means the pressure hose extends at least from the fixed feed pipe to the passage means;

a connector coupling the shower hose and the pressure hose at the interior end of the shower hose, the connector and the passage means preventing unintentional passage of said connector through said passage means from the interior side of the passage means to the exterior side upon withdrawal of the shower hose, by interference between the connector and the passage means, and, wherein the passage means includes a blocking element dimensioned to block passage of the connector through the passage means, the blocking element being detachable from the passage means.

20. The fixture according to claim 19, further comprising a container surrounding a length of the shower hose between the passage means and the connector, the container being sealed watertight with at least one of the shower hose and the pressure hose adjacent the interior end of the shower hose.

* * * * *

UNITED STATES PATENT AND TRADEMARK OFFICE

CERTIFICATE OF CORRECTION

PATENT NO. : 5,277,454
DATED : January 11, 1994
INVENTOR(S) : Lorch et al.

It is certified that error appears in the above-indentified patent and that said Letters Patent is hereby corrected as shown below:

Column 2, lines 23 delete "for", first occurrence.

Column 4, line 65, replace "4" with --14--.

Column 5, line 4, replace "22" with --21--.

Column 8, line 30, replace "10" with --13--.

Signed and Sealed this

Thirtieth Day of August, 1994

*Attest:*

*Attesting Officer*

Bruce Lehman

BRUCE LEHMAN

*Commissioner of Patents and Trademarks*